US007097093B2

(12) United States Patent
Darin et al.

(10) Patent No.: US 7,097,093 B2
(45) Date of Patent: Aug. 29, 2006

(54) CARTON OPENING FEATURE

(75) Inventors: Neil E. Darin, Grayslake, IL (US); Christopher P. Guzowski, Hoffman Estates, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 185 days.

(21) Appl. No.: 10/303,684

(22) Filed: Nov. 25, 2002

(65) Prior Publication Data

US 2004/0099722 A1 May 27, 2004

(51) Int. Cl.
*B65D 17/00* (2006.01)

(52) U.S. Cl. ..... 229/232; 229/207; 229/160.2

(58) Field of Classification Search ..... 229/231, 229/232, 212, 207, 236, 117.27, 117.3, 215, 229/217, 125.42, 160.1, 122, 125.09, 148, 229/145, 103.1, 121, 244, 160.2
See application file for complete search history.

(56) References Cited

U.S. PATENT DOCUMENTS

| | | | | | |
|---|---|---|---|---|---|
| 2,626,096 | A | | 1/1953 | Hickin | |
| 2,679,349 | A | | 5/1954 | Mullinix | |
| 2,819,832 | A | * | 1/1958 | Stoller | 229/233 |
| 2,898,822 | A | * | 8/1959 | Moore | 493/87 |
| 2,936,937 | A | | 5/1960 | Guyer | |
| 2,953,293 | A | | 9/1960 | Anderson | |
| 3,146,936 | A | * | 9/1964 | Hodapp | 229/231 |
| 3,186,623 | A | | 6/1965 | Guyer | |
| 3,187,978 | A | * | 6/1965 | Graybill | 229/131.1 |
| 3,226,003 | A | | 12/1965 | Hickin | |
| 3,270,941 | A | * | 9/1966 | Barnes | 229/212 |
| 3,301,391 | A | | 1/1967 | Guyer | |
| 3,357,631 | A | * | 12/1967 | Aid et al. | 229/232 |
| 3,521,809 | A | | 7/1970 | Zimmerman | |
| 3,735,914 | A | | 5/1973 | Collura et al. | |
| 3,905,646 | A | | 9/1975 | Brackmann et al. | |
| 3,982,685 | A | | 9/1976 | Shimada | |
| 4,158,412 | A | | 6/1979 | Shimada | |
| 4,317,518 | A | | 3/1982 | Mode | |
| 4,449,633 | A | | 5/1984 | Johnson et al. | |
| 4,613,046 | A | | 9/1986 | Kuchenbecker | |
| 4,687,104 | A | * | 8/1987 | Ielmini | 229/207 |
| 4,712,737 | A | | 12/1987 | Hecking | |
| 4,951,824 | A | * | 8/1990 | Kuchenbecker et al. | 229/207 |
| 4,982,846 | A | * | 1/1991 | Friedman | 229/212 |
| 5,012,929 | A | | 5/1991 | Roosa | |
| 5,035,330 | A | | 7/1991 | Kuchenbecker | |
| 5,114,013 | A | | 5/1992 | Brown et al. | |
| 5,123,589 | A | * | 6/1992 | Cote | 229/232 |
| 5,259,552 | A | | 11/1993 | Kuchenbecker | |
| 5,402,933 | A | * | 4/1995 | Behrmann | 229/231 |
| 5,577,612 | A | * | 11/1996 | Chesson et al. | 206/494 |
| 5,810,250 | A | | 9/1998 | Stone et al. | |
| 5,875,961 | A | | 3/1999 | Stone et al. | |
| 5,996,886 | A | | 12/1999 | Evert | |
| 6,138,905 | A | | 10/2000 | Hachenski | |
| 2002/0011515 | A1 | * | 1/2002 | Walsh et al. | 229/231 |

* cited by examiner

*Primary Examiner*—Tri M. Mai
(74) *Attorney, Agent, or Firm*—Fitch, Even, Tabin & Flannery

(57) ABSTRACT

A carton is provided having a door that is shiftable from a closed position to an open position to permit access to an interior of the carton. The door includes a gripping tab for opening the door. The gripping tab is restricted from movement by a blocking member prior to the initial shifting of the door from the closed position to the open position. Upon sufficient movement of the gripping tab, the blocking member is removable to permit shifting of the door from the closed position to the open position, thereby permitting access to the interior of the carton.

27 Claims, 2 Drawing Sheets

CARTON OPENING FEATURE

FIELD

The apparatus and methods described herein relate generally to a carton, and particularly to a carton having an opening feature allowing access to an interior of the carton.

BACKGROUND

Cartons are often used as packaging for a variety of consumer products. The carton may be configured for opening by the consumer for removal of the contents from the interior thereof. The marketing, distribution and sale of contents packaged in cartons for consumers often requires considerable attention to the design of the cartons used to package such products. In particular, it is generally desirable to design such cartons with a feature that permits the purchaser to open the carton with a minimal amount of physical effort to gain access to the contents.

One type of carton is provided with a pair of overlapping flaps or panels on one end that are attached relative to each other. Often, the overlapping panels are merely glued together, requiring the consumer to break the glue bonding the two overlapping panels to gain access to the interior of the carton. Considerable effort may be required by the consumer to break the adhesive bonding between the panels, and can result in uncontrolled tears in the carton. To address these concerns, some cartons have been provided with a tear strip between the overlapping panels, allowing a consumer to remove the tear strip to allow the panels to separate in order to gain access to the interior of the carton.

Other types of cartons use opening features comprising a perforated region formed in the carton that is intended to be openable by pressing a thumb or finger against the perforated region of the carton. Perforated regions for opening cartons may be located at various parts of the carton, such as upper portions of a side panel or on the top panel of the carton. After opening of the perforated regions, such regions may be designed to remain connected to the carton wall by a hinge so that the perforated region is not detached from the carton.

Many such opening features in the form of perforated regions are found in existing carton designs for paperboard cartons. The perforated regions may be bordered by a series of perforations, reverse cuts, score lines, or cut lines in the surface of a carton wall in the shape of a "V", a "U", an oval, a rectangle or other shapes. The carton is opened by pressing the perforated region toward the interior of the carton so that the carton wall ruptures or tears along the perforations to form an opening allowing access to the interior of the carton.

However, these regions often require considerable opening force because the perforations may not fully penetrate the panel and may not be of sufficient size to permit easy opening of the carton. The force required to open perforated regions in many instances can cause the carton panels to deform, bend or even collapse, and can render the perforated region itself inoperable. These types of opening problems can lead to consumer frustration and complaints, which can result in lost sales and increased costs for returned goods.

The open perforated region may be configured to act as a finger grip that allow the user to create a larger opening in the carton. In such cartons, the perforated region can first be depressed into the interior of the carton by the consumer. Next, the consumer can pull on the perforated region, such as toward a side or top of the carton, to peel back a panel of the carton and to create an enlarged opening permitting improved access to the contents of the carton. In some cartons, the carton side or top panel may be removed entirely.

The use of a perforated region as described above to provide an opening for further opening the carton may be employed in cartons for bulk products such as pastas, cereals and similar food stuffs. Often sauce packets or other flavoring packets are provided with the bulky, pourable products. The removal of such packets can be difficult when the bulk contents shift during shipping and handling prior to opening by a consumer. When a consumer finally opens the carton, the bulk contents and the packets may have shifted in a manner to cause difficulty in removing the bulk contents and the packets from the interior of the carton. In some instances, the packets can even block the openings of the carton, further causing difficulty in removing the bulk contents.

The design of carton opening features requires consideration of a number of objectives and performance requirements in addition to providing for convenient opening of the carton by a consumer. The easy open features in such cartons should not compromise the structural integrity and strength of the carton. Paperboard cartons often are subjected to a variety of loads and stress during shipping, storage, and handling of the cartons. These include stresses and loads experienced during the packing of individual cartons in shipping cases, in palletizing the cases for storage at warehouse facilities, and during shipment, stacking, and other movement of pallets. Once the cartons reach a retailer, they may be subjected to additional stresses and loads during the shelving and display of the product. Consumers purchasing such cartons may further subject the cartons to stresses and loads that can cause unintentional openings or deformation of the carton.

Cartons are typically made from a precut, unitary blank having prescored lines that permit the folding, forming, filling and sealing of the cartons using automated machinery. For many such cartons, an easy open design must be integrated into the overall carton structure with a minimum of complicated or added components. For example, the easy open features in paperboard cartons frequently must be integral to a unitary paperboard blank used to form the carton to simplify assembly of the carton and reduce material and assembly costs. It is desirable to avoid the need for unnecessary panels, folds, glues, inserts, reinforcements or the like to form the easy open feature to reduce the cost of the carton and the steps needed to form the carton.

Thus, there remains a need to provide cartons capable of inexpensive mass production and suitable for retail sale having an opening feature configured for simplified access to the interior of the carton after packing, shipping, and handling of the carton.

SUMMARY

New improved apparatus and methods are provided for opening a carton to gain access to an interior of the carton and any contents therein. This is achieved by using a carton opening feature which may comprise a gripping tab operably connected to a door for shifting the door from a closed position to an open position. A blocking member is provided that restricts unintentional movement of the gripping tab and thus opening of the door until the door is initially shifted to the open position.

The carton may be defined by a plurality of panels, including a first panel and a second panel adjacent the first panel. The first panel has a window opening formed therein. The second panel has a door openable to provide access to the interior of the carton. An end of the door has an operably connected gripping tab at least partially accessible through the window of the first panel. The tab allows for reopening of the door to permit access to the interior of the carton.

The window opening may be surrounded by the first panel, and a portion of the gripping tab of the door may be disposed behind the first panel to both prevent inadvertent opening of the carton and to generally protect the gripping tab from displacement during packaging, shipping, and handling of the carton. An end of the door opposite the end having the gripping tab may be pivotably attached by a hinge to the second panel. A pair of side edges of the door may each be removably attached to the second panel along an area of weakness. The spacing between the areas of weakness may decrease between the end of the door having the gripping tab and the opposite end of the door hinged to the second panel. In one aspect, each of the areas of weakness may comprise an inner partial cut and an outer partial cut. The inner partial cuts may be formed in the side of the panels facing the interior of the carton, and the outer partial cuts may be formed in the side of the panel facing away from the interior of the carton.

A blocking portion of the first panel is disposed adjacent the window opening between the window opening and the second panel. The blocking portion can hinder inadvertent displacement of the gripping tab, such as during packaging, shipping, and handling. In addition, the blocking portion can restrict unintentional opening of the door by substantially preventing movement of the gripping member to shift the door to the open position unless the blocking member is removed. The blocking portion of the first panel is separable from the remainder of the first panel along one or more lines of weakness. The window may include a region having an increasing width adjacent the lines of weakness to facilitate controlled propagation of tears beginning along portions of the lines of weakness adjacent the opening. The region of increasing width may be aligned with the areas of weakness of the blocking portion. The areas of weakness may comprise partial inner cuts extending diagonally from the region of increased width of the window opening to at least one of the edges of the first panel. The cut may extend from the opening to the side edge of the first panel, the inner section of the upper edge and the side edge of the first panel or the upper edge of the first panel.

In another aspect, an opening feature for a carton is provided to permit access to an interior of the carton. The opening feature includes a door selectively shiftable from a closed position whereby access is restricted to the interior of the carton to an open position whereby access is allowed to the interior of the carton. A pull member is operably connected to the door by an intermediate connection element. The pull member has a first state when the door is in the closed position and a second state when the door is in the open position. Movement of the pull member from the first state to the second state shifts the door to its open position. A blocking element is provided to cover at least a portion of the intermediate connection element in order to restrict unintentional displacement, such as during shipping and handling, of the intermediate connection element and the pull member prior to movement of the pull member from the first state to the second state for shifting the door to the open position.

A joint may be provided between the blocking element and the carton to allow for detachment of the blocking element relative to the carton. The joint may comprise one or more lines of weakness between the blocking element and the carton. The line of weakness may be breakable when the pull element is moved from its first state to its second state allowing the blocking element to move relative to the carton. The blocking element may be adjacent an opening in an outer wall of the carton. At least a portion of the pull member may be accessible through the opening.

The door may be integrally formed in an access wall of the carton. In the closed position, the door may be connected to the access wall of the carton by one or more joints each comprising a line of weakness. The lines of weakness may be breakable when the door is shifted from the closed position to the open position, allowing the door to separate from the access wall to permit access to the interior of the carton. The joint may comprise one or more pairs of lines of weakness extending along side edges of the door from an end of the door to a hinge between the access wall and the door. The door may be openable with respect to the access wall about the hinge when shifted from the closed position to the open position. In a preferred embodiment, the access wall may be adjacent to the outer wall of the carton. In addition, in a preferred embodiment of the carton the carton may be generally rectangular in shape.

In another aspect, a generally rectangular carton is provided having an interior. The carton includes a top panel and a bottom panel opposite the top panel. One of the top and bottom panels has a door for selectively permitting access to the interior of the carton through an access opening. The door has a closed position substantially blocking the access opening and an open position permitting access to the interior of the carton through the access opening. A hinge is provided to connect a first end of the door to the one of the top and bottom panels. A second end of the door is operably connected to a gripping tab by a tab panel for shifting the door from the closed position to the opened position. A carton also includes a pair of side panels. Each side panel extends between edges of the top and bottom panels. One of the side panels covers at least part of the tab panel and has an opening permitting access to the gripping tab. The carton further includes a front panel extending between edges of the top, bottom and side panels, and a back panel opposite the front panel also extending between edges of the top, bottom and side panels.

A blocking portion may be provided that is detachably connected to the one of the side panels. The blocking portion may cover at least a portion of the tab panel restricting unintentional movement of the gripping tab to hinder inadvertent shifting of the door from the closed position to the open position. The blocking portion may be detachably connected to the one of the side panels. The door may be detachably connected to the one of the top and bottom panels along a pair of lines of weakness, each disposed on opposite side edges of the door and extending between the ends of the door in the closed position. The lines of weakness are rupturable to separate the door from the one of the top and bottom panels permitting shifting of the door from the closed position to the open position.

In another aspect, a method of opening a carton is provided. The method comprises providing a pair of adjacent panels. One of the adjacent panels has an opening and the other of the adjacent panels has a door with a door opening portion. The method further comprises lifting a pull tab of the door opening portion. The pull tab may be at least partially aligned within the opening. The method further comprises pulling the pull tab of the door opening feature to separate a border of the opening from the one of the adjacent panels. The method further comprises opening the door by pulling the pull tab of the door opening feature.

DETAILED DESCRIPTION

Figure 1:
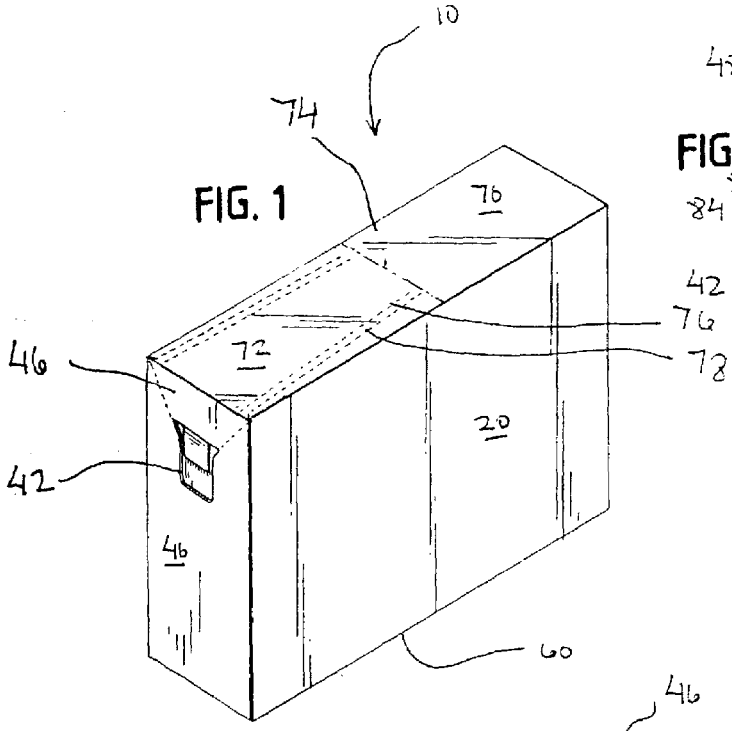
FIG. 1 is a perspective view of a carton having an opening feature for opening a door on a top panel, shown with the door in a closed position prior to opening.

As shown in FIGS. 1–4 for purposes of illustration, there is illustrated an embodiment which generally comprises a carton 10 formed of multiple panels. One of the panels 70 has a door 72 that is shiftable from a closed position to an open position to permit access to an interior of the carton 10. The door 72 includes a gripping tab 84 at one end that facilitates the initial shifting of the door 72 from the closed position to the open position upon movement of the gripping tab 84. When the door 72 is in the closed position prior to being initially shifted to the open position, the gripping tab 84 is restricted from movement by a blocking member 46 formed on a panel 40 adjacent to the panel 70 having the door 72. The blocking member 46 substantially restricts inadvertent opening of the door 72 and deformation of the gripping tab 84 prior to use in opening the door 72, such as during packaging, shipping, and handling. Upon sufficient movement of the gripping tab 84, the blocking member 46 can be detached from the panel 40 adjacent to the panel 70 having the door 72 to permit further movement of the gripping tab 84 to shift the door 72 from the closed position to the open position thereof for permitting access to the interior of the carton 10.

Figure 3:
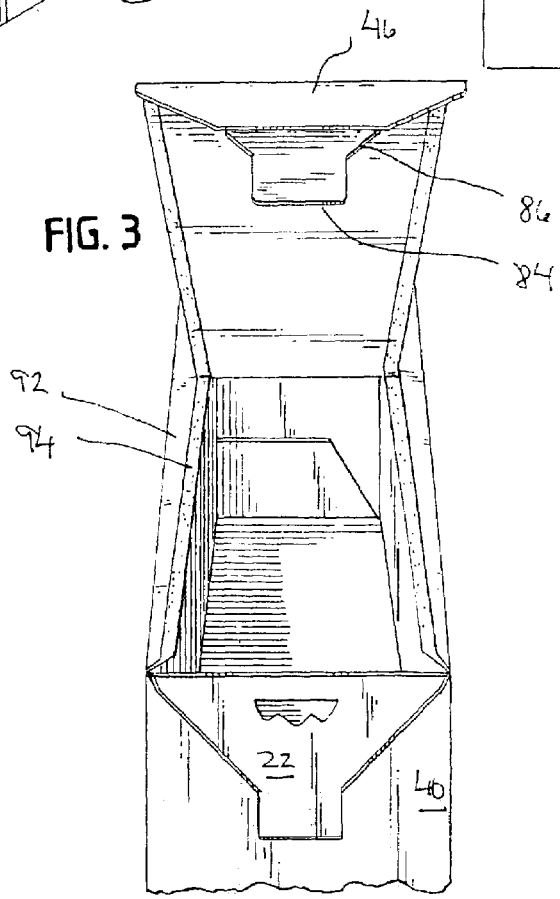
FIG. 3 is a perspective view of the carton of FIG. 1 showing the opening feature after opening and the door in an open position.

A door 72 is positioned on the top panel 70 of the carton 10 for providing access to the interior of the carton 10. The door 72 is shiftable from an initial, closed position, as illustrated in FIG. 1, to an open position, as illustrated in FIG. 3. One end of the door 72 is pivotably connected to the top panel 70 about a hinge 74. The other end of the door 72 has an attached upper minor flap 82 with a gripping tab 84 depending therefrom. Movement of the gripping tab 84 thus urges the door 72 to pivot about the hinge 74 to shift the door 72 from the closed position to the open position to permit access to the interior of the carton 10.

The door 72 is integrally formed with the top panel 70. As discussed above, one of the ends of the door 72 is connected to the top panel 70 about a hinge 74 and the other of the ends has the attached upper minor flap 82 and the gripping tab 84. Lateral edges of the door 72 are each joined to the top panel 70 along areas of weakness 75 rupturable to permit separation of the lateral edges of the door 72 from the top panel 70 for shifting the door 72 to the open position.

Prior to initially shifting the door 72 to the open position using the gripping tab 84, the gripping tab 84 and the upper minor flap 82 are positioned partially beneath one of the side panels 40. The window opening 42 is formed in the one of the side panels 40 and is positioned so that at least a portion of the gripping tab 84 is accessible through the opening 42 prior to initially shifting the door 72 from its closed position to its open position. The window 42 is preferably sized to allow a consumer to access the gripping tab 84 therethrough, such as with fingers, for opening the door 72.

Figure 2:
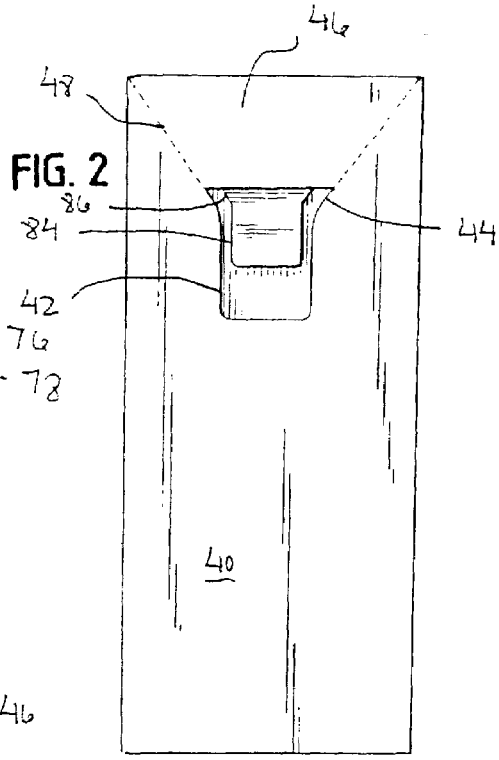
FIG. 2 is a side elevation view of the carton of FIG. 1 showing a portion of the opening feature prior to opening.

The window opening 42 is preferably bordered on all sides by the side panel 40. The blocking member 46 is integrally formed with the side panel 40 of the carton 10, as illustrated in FIG. 2, and is preferably the upper border of the window opening 42. The blocking member 46 is detachably connected to the remainder of the first panel 40 along a pair of lines of weakness 48 to allow for the gripping tab 84 to initially shift the door 72 from the closed position to the open position.

The blocking member 46 is positioned to generally protect the gripping tab 42 from substantial displacement and deformation during packaging, shipping, and handling to ensure proper opening of the carton 10 by a consumer. To this end, the blocking member 46 is placed over a portion of the gripping tab 84 so that gripping tab 84 preferably does not protrude beyond the side panel 40 having the window opening 42. The window 42 defines a recess having a depth greater than or equal to the thickness of the gripping tab 84. By holding the upper minor panel 82 against the inner side panel 22 of the carton 10 and in the recess, the blocking member 46 helps to maintain the gripping tab 84 against the inner side panel 22 so that the tab 84 does not project substantially beyond the parameter of the carton 10 where it could become caught on adjacent cartons 10 or otherwise displaced.

During assembly, the blocking member 46 is secured relative to the upper minor side panel 82 having the gripping tab 84 such that when the blocking member 46 is separated from the outer side panel 40 it remains attached to the upper minor side panel 82 so as to not generate a separate piece of the carton 10 which must be disposed independently of the carton 10 after the contents have been removed therefrom.

The lines of weakness 48 extend from the window opening 42 to edges of the side panel 40 such that when the gripping tab 84 is moved for shifting the door 72 from the closed position to the open position the blocking member 46 separates from the remainder of the side panel 40 along the lines of weakness 48. In a preferred embodiment, the lines of weakness 48 comprise perforations, although partial reverse cuts made on the inner side of the side panel 40 may also be used. The lines of weakness 48 preferably each extend from the window opening 42 diagonally to a corner of the side panel 40 proximate the door 72 to facilitate shifting of the door 72 to the open position.

To facilitate separation of the blocking member 46 from the outer side panel 40, the upper minor panel 82 has side edges 86 with an angle generally corresponding to the angle of the lines of weakness 48. When the gripping tab 42 is moved a sufficient distance and with a sufficient force, the side edges 86 of the upper minor panel 40 press against the lines of weakness 48 to break the lines of weakness 48 and allow the blocking member 46 to separate from the outer side panel 40.

The paperboard forming the carton 10 has two layers 92 and 94. The first or base layer 94 faces the interior of the carton 10. The second or surface layer 92 is disposed on top of the base layer 94 facing the exterior of the carton 10. The surface layer 92 has a semi-glossy coating to enhance the appearance of the carton 10. In some instances, the surface layer 92 may have indicia printed thereon to identify the contents of the carton 10 or the brand of the contents. Due to the dual layer construction of the paperboard forming the carton 10, it is desirable to provide for a controlled break along the areas of weakness 75 so that there is minimal separation of the layers 92 and 94 and minimal deviation from the predetermined areas of weakness 75 during the separation of the door 72 from the top panel 70 when the door 72 is initially shifted from the closed position to the open position.

To this end, the areas of weakness 75 formed on the top panel to allow the door 72 to separate therefrom each comprise two parallel lines of weakness 76 and 78. Thus, there are four lines of weakness 76 and 78 rupturable to permit shifting of the door 72 from the closed position to the open position, an inner pair 76 and an outer pair 78. The inner pair 76 of the lines of weakness preferably comprise partial reverse cuts in the paperboard. The inner pair 76 of the lines of weakness are preferably continuous, unbroken cuts through at least a portion of the base layer 94 of the paperboard, thereby allowing the base layer 94 to separate from the surface layer 92 along the cuts 76. The outer pair 78 of the lines of weakness comprise partial cuts in the paperboard. Preferably, the outer pair 78 of the lines of weakness are broken partial cuts through at least a portion of the surface layer 92, thereby allowing the surface layer 92 to separate from the base layer 94 along the cuts 78.

When the door 72 is initially shifted from its closed position to its open position it separates from the top panel 70 along both the inner and outer lines of weakness 76 and 78, as best illustrated in FIG. 3. More specifically, the outer pair of cuts 78 allows the surface layer 92 of the paperboard forming the door 72 to separate from the surface layer 92 of the paperboard forming the top panel 70. Similarly, the inner pair of reverse cuts 88 allows the base layer 94 of the paperboard forming the door 72 to separate from the base layer 94 of paper board forming the top panel 70. In this manner, the initial opening of the door 72 along the areas of weakness is controlled to minimize deviation of the tear from between the inner and outer cuts 76 and 78 on each side of the top surface 92.

Turning to more of details, various aspects of the carton 10 are configured to facilitate the initial shifting of the door 72 from the closed position to the open position. For example, in order to facilitate opening of the carton 10 along the areas of weakness 75 in a controlled manner and with minimal exertion of opening force, the spacing between the areas of weakness 75 decreases from where the upper minor flap 82 having the gripping tab 84 meets the front end of the door 72 to the hinge 74. The areas of weakness 75, each comprising the generally parallel pair of lines of weakness 76 and 78, begin at the intersection of the front end of the door 72 with the upper minor panel 82 and extend to the hinge 74 between the door 72 and the top panel 70. More specifically, the inner pair of the lines of weakness 76 begin at the intersection of the front end of the door 72 with the upper minor flap 82 and are spaced a distance inward from lateral edges of the top panel 70. The outer pair 78 of the lines of weakness are parallel to the inner pair 76 of the lines of weakness, except at the intersection of the front end of the door 72 with the upper minor panel 82. There, the outer pair 78 of the lines of weakness each have a portion 79 extending at a diagonal to the corners of the lateral edges of the top panel 70. In this manner, the initial shifting of the door 72 from the closed position to the open position along the diagonal portion 79 can cause the tear to propagate from the corners of the lateral edges of the top panel 70 to minimize the likelihood of deviation of the tear from the lines of weakness 76 and 78 because, due to a fold between the upper minor panel 82 and the door 72, the corners represent a preweakened area susceptible to tearing.

The upper minor panel 82 is configured to control the tear between the door 72 and the top panel 70 and ensure that the tear propagates along the areas of weakness 75. More particularly, the intersection between the upper minor panel 82 and the top panel is configured so that the tear begins at the intersection between the corners of the top panel 70 adjacent the upper minor panel 82 along the diagonal portions 79 of the outer lines of weakness 78. To this end, the diagonal edges 86 of the upper minor panel 82 do not continue to the intersection of the upper minor panel 82 and the top panel 70. Instead, corner elements 88 are provided along the upper end of the upper minor panel 82 adjacent the top panel 70. The corner elements 88 give the upper minor panel 82 a short region having a width nearly the same as the width of the top panel 70 to reduce the likelihood of the tear beginning to propagate at a location other than along the diagonal portions 79.

Figure 4:
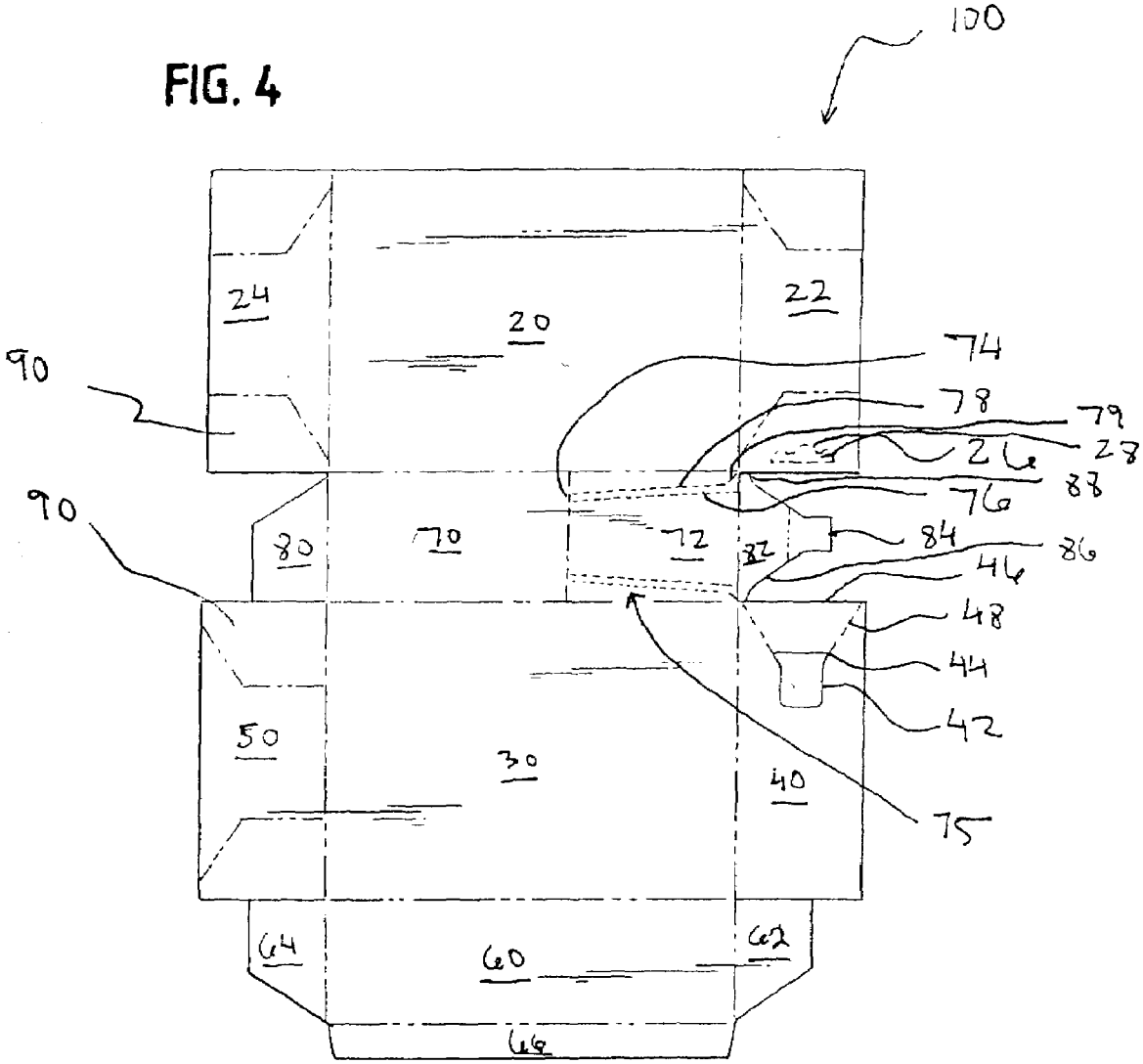
FIG. 4 is a plan view of a carton blank for forming the carton of FIG. 1.

The container or carton 10 is assembled from a carton blank 100, as illustrated in FIG. 4. The carton blank 100 may be cut from a paperboard sheet using a die cutting machine. The paperboard sheet may comprise multiple layers, including a bottom layer 94 and a top layer 92, as discussed in detail above. The carton blank 100 includes a rectangular front panel 20 having a pair of larger side edges and a pair of smaller side edges. One of the pair of the large side edges of the front panel 20 is connected to the top panel 70 about a fold line. Each of the smaller side edges of the front panel 20 are connected to inner side panels 22 and 24 about fold lines.

The top panel 70, which includes the door 72, also is rectangular in shape, having a pair of larger edges and a pair of smaller edges. A fold between the front panel 20 and the top panel 70 connects one of the larger edges of the front panel 20 with one of the larger edges of the top panel 70. A pair of upper minor flaps 80 and 82 are each connected about a fold line to one of the smaller side edges of the top panel 70. One of the upper minor flaps 82, connected to the door 72, has angled side edges 86, as discussed in more detail above, and includes the gripping tab 84 at an end thereof opposite the connection of the one of the upper minor flaps 82 with the top panel 70.

Connected about a fold to the one of the larger side edges of the top panel 70 opposite the fold connecting the front panel 20 and the top panel 70 is the back panel 30. The back panel 30 is also rectangular, having the same dimensions as the front panel 20, including a pair of larger side edges and a pair of smaller side edges. The fold between the top panel 70 and the back panel 30 connects the large side edges of each. A pair of outer side panels 40 and 50 are connected to the smaller edges of the back panel 30. As discussed above in more detail, one of the side panels 40 has a window opening 42 formed therein for providing access to the gripping tab 84 when the blank 100 is assembled into the carton 10.

A bottom panel 60 is connected by a fold to one of the larger edges of the back panel 30 opposite the fold between the top panel 70 and the back panel 30. The bottom panel 60 is rectangular and is dimensioned similar to the top panel 70, including a pair of larger side edges and a pair of smaller side edges. Along each of the smaller edges of the bottom panel 60, minor bottom side panels 62 and 64 are connected via a fold. Along the one of the larger edges of the bottom panel 60 opposite the back panel 30 is a bottom joint panel 66, the purpose of which will be more fully explained below.

To assemble the carton blank 100 into the carton 10, the front 20 panel, the top panel 70, the back panel 30, and the bottom panel are folded perpendicularly relative to their adjacent panel. The bottom joint panel 66 is then folded perpendicularly relative to the bottom panel 60 and placed against the inside surface of the front panel proximate the larger side edge opposite the top panel 70. Adhesive or other bonding mechanisms may be placed between the bottom joint panel 66 and the inside surface of the front panel 20 to secure the bottom joint panel 66 relative to the front panel 20 to form an intermediate stage in the assembly of the carton 10 whereby the carton 10 is partially formed and has a pair of open ends.

In closing the pair of open ends of the partially assembled carton 10 in the intermediate state, the end having the opening feature is preferably closed in the same order as the end not having the opening feature. More specifically, in order to provide the gripping tab 84 within the window opening 42 of the side panel 40, the closing of the end having the opening feature involves first folding the inner side panel 22 inward and perpendicularly relative to the front panel 20. Next, the upper and lower minor flaps 62 and 82 are folded against the inner side panel 22. Finally, the outer side panel 40 is folded inward against the upper and lower minor panels 62 and 82. Similarly, in closing the end lacking the opening feature, the inner side panel 24 is folded inward. Next, the upper and lower minor panels 64 and 80 are first folded inward against the inner side panel 24 and perpendicularly relative to the front panel 20. Finally, the outer side panel 50 is folded against the inner side panel 24 with the upper and lower minor panels 64 and 80 therebetween. Adhesive or other bonding mechanisms may be provided to secure the panels relative to each other to complete assembly of the carton 10. During these carton blank 100 assembly steps, the product can be inserted through one of the ends prior to closing, although other ways of inserting the product into the carton 10 during assembly of the carton blank 100 may be equally suitable.

As apparent from the steps described above for assembling the carton blank 100 into the carton 10, in some areas of the carton 10 several layers of paperboard are placed against each other. For example, on a lower region of a side of the carton 10 there are three layers of paperboard against each other, the inner panel 24, the bottom minor panel 64, and the outer side panel 50. To reduce the apparent thickness of these three panels and improve the visual appearance of the assembled carton 10, the inner and outer side panels 24 and 50 are provided with embossed regions 90 to provide for nesting of the bottom minor panel 64 therebetween. The embossed regions 90 comprise stamped areas that allow for the region 90 to move either inwardly or outwardly with respect to the panel 24 or 50. For instance, the embossed region 90 on the inner side panel 24 can move inwardly while the embossed region 90 on the outer side panel 50 can move outwardly when the bottom minor panel 64 is placed therebetween. Similarly, embossed regions 90 are provided between the inner and outer panels 24 and 50 and the upper minor flap 80, as well as the inner and outer side panels 22 and 40 and the bottom minor panel 62. While the inner panel 22 adjacent the upper minor panel 82 having the gripping tab 84 has an embossed region 90, the outer panel 40 lacks an embossed region 90 so as to not interfere with the window opening 42 and removable blocking member 48.

During assembly of the carton blank 100 into the carton 10, care is taken to ensure that gripping tab 84 is not only aligned with the window opening 42 in the one of the side panels 40, but that the upper minor panel 82 having the gripping tab 84 is readily movable relative to the adjacent inner panel 22 to facilitate the initial shifting of the door 72 from the closed position to the open position. To this end, the upper minor panel 82 having the gripping tab 84 may lack adhesive for bonding the panel 82 relative to the adjacent inner panel 22.

However, it may be desirable to provide a quickly releasable bond between the inner side panel 22 and the upper minor panel 82 having the gripping portion 84 to provide additional strength to the assembled carton 10. To facilitate the ease of quickly releasing the bond between the inner side panel 22 and the upper minor panel 82, the bond may be between a perforated portion 26 of the inner panel 22 and the upper minor panel 82. When the gripping tab 84 is moved with sufficient force and a sufficient distance to separate the blocking member 46 from the outer side panel 40 having the window opening 42, the perforated portion 26 is separably from the inner side panel 22 along lines of weakness 28, and preferably along a perforation cut. The perforated portion 26 has shape selected to facilitate separation along the lines of weakness 28 from the inner side panel 22. The shape may include one or more round regions along the bottom where the tear can easily begin to propagate.

In a preferred embodiment of the carton 10, the carton 10 is sized to contain a prepackaged macaroni and cheese kit. The kit includes a quantity of macaroni or shells pasta and a cheese sauce pack. During packaging of the kit into the carton 10, the cheese sauce pack is placed below the door 72 so that when the door 72 is opened the cheese sauce pack can be withdrawn. Accordingly, the door 72 is dimensioned to accommodate withdrawal of the cheese sauce pack through the opening formed after the door 72 is initially shifted from its closed position to its open position. More specifically, the door 72 is between about 2.75 inches and 3.25 inches long, and more preferably is about 3 inches long. The width of the door 72 is about 1.625 inches at the widest portion, and is about 1.375 inches at the narrowest portion. The carton 10 is preferably sized to contain the cheese sauce pack and pasta. More particularly, the carton 10 is between about 4.25 inches and 4.75 inches in height, between about 1.625 inches and 2.125 inches in width, and between about 6 inches and 6.5 inches in length. More preferably, the carton 10 is about 4.5 inches in height, about 1.875 inches in width, and about 6.25 inches in length. Although particular carton dimensions are described herein for use in a macaroni and cheese meal kit, the opening features, including the gripping tab 84, is equally suitable for use on other sizes of cartons and containers, and cartons and containers having different contents other than pasta and sauce packets.

To open the assembled carton 10, the gripping tab 84 of the upper minor panel 82 is grasped through the window opening 42 in the outer side panel 40. Next, the gripping tab 84 is pulled toward the top panel 70 with sufficient force to separate the blocking member 46 from the outer side panel 40 along the lines of weakness 48. Continued pulling of the gripping tab 84 separates the door 72 from the top panel 70 along the inner and outer lines of weakness 76 and 78 to open the door 72, thereby permitting access to the interior of the carton 10.

As can be appreciated from the above description of FIGS. 1–4, there is provided a new carton opening feature, which provides the improved result of simplifying opening of the carton by providing an opening feature including a gripping tab for opening a door, while protecting the opening feature from displacement during shipping and handling of the carton. While there have been illustrated and described particular embodiments, it will be appreciated that numerous changes and modifications will occur to those skilled in the art, and it is intended in the appended claims to cover all those changes and modifications which fall within the true spirit and scope thereof.

The invention claimed is:

1. A carton for containing a product in an interior thereof defined by a plurality of panels, the carton comprising:

a first panel having a window opening formed therein, the window opening being surrounded by the first panel and spaced from a top edge of the first panel by a generally planar portion of the first panel; and a second panel adjacent the first panel at the top edge thereof, the second panel having a door openable to provide access to the interior of the carton, an end of the door having a gripping tab, the gripping tab being at least partially accessible through the window of the first panel, the majority of the gripping tab being visible from the exterior of the carton prior to opening and a portion of the gripping tab of the door being disposed behind the first panel, the tab allowing opening of the door to permit access to the interior of the carton.

2. The carton in accordance with claim 1, wherein an end of the door opposite the end having the gripping tab is attached by a hinge to the second panel and a pair of side edges of the door are each removably attached to the second panel along an area of weakness.

3. The carton in accordance with claim 2, wherein the spacing between the areas of weakness along the side edges of the door decreases between the end of the door having the gripping tab and the opposite end of the door.

4. The carton in accordance with claim 3, wherein each of the areas of weakness comprises an inner partial cut and an outer partial cut.

5. The carton in accordance with claim 1, wherein a blocking portion of the first panel adjacent the window opening is disposed between the window opening and the second panel, the blocking portion of the first panel being separable from the remainder of the first panel along at least one line of weakness between the blocking portion and the first panel.

6. The carton in accordance with claim 5, wherein the window includes a region having an increasing width, the region of increasing width being aligned with the areas of weakness of the blocking portion.

7. The carton in accordance with claim 6, wherein the areas of weakness of the blocking portion comprise inner partial cuts extending diagonally from the window to at least one edge of the first panel.

8. An opening feature for a carton permitting access to an interior of the carton, the opening feature comprising:

a door selectively shiftable from a closed position restricting access to the interior of the carton to an open position allowing access to the interior of the carton;

a pull member operably connected to the door by an intermediate connection element, the pull member having a first state when the door is in the closed position and a second state when the door is in the open position, movement of the pull member from the first state to the second state shifting the door to its open position; and a generally planar blocking element covering at least a portion of the intermediate connection element restricting displacement of the intermediate connection element prior to movement of the pull member from the first state to the second state for shifting the door to the open position, the blocking element being a part of and coplanar with an outer panel of the carton and defining a portion of an opening in the outer panel of the carton being spaced from an edge of the outer panel adjacent the door by the blocking portion, the outer panel of the carton being separate from the intermediate connection element, and at least a portion of the pull tab being accessible through the opening and the majority of the gripping tab being visible from the exterior of the carton prior to opening.

9. The carton opening feature in accordance with claim 8, wherein a joint is provided between the blocking element and the carton to restrict movement of the blocking element relative to the carton.

10. The carton opening feature in accordance with claim 9, wherein the joint comprises a line of weakness between the blocking element and the carton, the line of weakness breakable when the pull element is moved from its first state to its second state allowing the blocking element to move relative to the carton.

11. The carton opening feature in accordance with claim 8, wherein the door is integrally formed in an access wall of the carton, the door being connected in the closed position to the access wall of the carton by a joint comprising a line of weakness, the line of weakness being breakable when the door is being shifted from the closed position to the open position allowing the door to separate from the access wall to permit access to the interior of the carton.

12. The carton opening feature in accordance with claim 11, wherein the joint comprises a pair of lines of weakness extending along sides of the door from an end of the door to a hinge between the access wall and the door, the door pivoting with respect to the access wall about the hinge when shifted from the closed position to the open position.

13. The carton opening feature in accordance with claim 12, wherein the access wall is adjacent the outer panel.

14. The carton opening feature in accordance with claim 13, wherein the carton is generally rectangular.

15. A generally rectangular carton having an interior, the carton comprising:

a first panel and a second panel opposite the first panel, the first panel having a door for selectively permitting access to the interior of the carton through an access opening, the door having a closed position substantially blocking the access opening and an open position permitting access to interior of the carton through the access opening;

a hinge connecting a first end of the door to the first panel;

a gripping tab operably connected to a second end of the door by a tab panel for shifting the door from the closed position to the open position;

a pair of side panels, each side panel extending between edges of the first and second panels, one of the side panels covering at least part of the tab panel, the one of the side panels having an opening spaced from a top edge of the side panel by a generally planar portion of the side panel framing at least a portion of the gripping tab, the gripping tab being visible through the opening from the exterior of the carton prior to opening;

a front panel extending between edges of the first, second, and side panels; and a back panel opposite the front panel extending between edges of the first, second, and side panels.

16. A generally rectangular carton in accordance with claim 15, wherein a blocking portion is detachably connected to the one of the side panels, the blocking portion covering at least a portion of the tab panel restricting movement of the gripping tab to shift the door from the closed position to the open position while detachably connected to the one of the of the side panels.

17. A generally rectangular carton in accordance with claim 16, wherein the door is detachably connected to the first panel along a pair of lines of weakness each on opposite sides of the door and extending between the ends of the door in the closed position, the lines of weakness being rupturable to separate the door from the first panel permitting shifting of the door from the closed position to the open position.

18. A method of assembling a carton blank into a carton, the method comprising:

providing a panel having a door shiftable between a closed position and an open position selectively permitting access to an interior of the carton;

providing a gripping tab operably connected to the door and movable between a first state where the door is in the closed position and a second state where the door is in the open position for shifting the door from the dosed position to the open position;

forming a blocking member by creating an aperture in a blocking panel, the blocking member comprising a border portion of the blocking panel adjacent the aperture and releasable from the blocking panel when the depending gripping tab is moved from the first state to the second state, the blocking member being formed of a separate panel from the gripping tab; and positioning the blocking member over the depending gripping tab for substantially preventing movement of the depending gripping tab from the first state to the second state prior to releasing the blocking member to substantially prevent shifting of the door from the closed position to the open position.

19. A carton for containing a product in an interior thereof defined by a plurality of panels the carton comprising:

a first panel having a window opening formed therein and spaced from a tap edge of the first panel;

a second panel adjacent the first panel, the second panel having a door openable to provide access to the interior of the carton, an end of the door having a tab panel connected thereto, the end of the tab panel opposite the door having a gripping tab, the gripping tab being at least partially accessible through the window of the first panel, the tab allowing opening of the door to permit access to the interior of the carton; and a generally planar blocking portion of the first panel and coplanar therewith adjacent the window opening being disposed between the window opening and the second panel, the blocking portion of the first panel being separable from the remainder of the first panel along at least one line of weakness between the blocking portion and the first panel.

20. The carton in accordance with claim 19, wherein the window includes a region having an increasing width, the region of increasing width being aligned with the areas of weakness of the blocking portion.

21. The carton in accordance with claim 20, wherein the areas of weakness of the blocking portion comprise inner partial cuts extending diagonally from the window to at least one edge of the first panel.

22. An opening feature for a carton permitting access to an interior of the carton, the opening feature comprising:

a door selectively shiftable from a closed position restricting access to the interior of the carton to an open position allowing access to the interior of the carton;

a pull member operably connected to the door by an intermediate connection element, the pull member having a first state when the door in the closed position and a second state when the door is in the open position, movement of the pull member from the first state to the second state shifting the door to its open position; and a generally planar blocking element covering at least a portion of the intermediate connection element restricting displacement of the intermediate connection element prior to movement of the pull member from the first state to the second state for shifting the door to the open position, the blocking element being adjacent an opening in an outer wall of a panel of the carton spaced from an edge of the panel adjacent the door and at least a portion of the pull tab being accessible through the opening, and a joint being provided between the blocking element and the carton to restrict movement of the blocking element relative to the carton, the joint being formed at least in part by a line of weakness between the blocking element and the carton, the line of weakness being breakable when the pull element is moved from its first state to its second state allowing the blocking element to move relative to the carton.

23. The carton opening feature in accordance with claim 22, wherein the door is integrally formed in an access wall of the carton, the door being connected in the closed position to the access wall of the carton by a joint comprising a line of weakness, the line of weakness being breakable when the door is being shifted from the closed position to the open position allowing the door to separate from the access wall to permit access to the interior of the carton.

24. The carton opening feature in accordance with claim 23, wherein the joint comprises a pair of lines of weakness extending along sides of the door from an end of the door to a hinge between the access wall and the door, the door pivoting with respect to the access wall about the hinge when shifted from the closed position to the open position.

25. The carton opening feature in accordance with claim 24, wherein the access wall is adjacent the outer wall.

26. The carton opening feature in accordance with claim 25, wherein the carton is generally rectangular.

27. A method of assembling a carton blank into a carton, the method comprising:

providing a panel having a door shiftable between a closed position and an open position selectively permitting access to an interior of the carton;

providing a gripping tab operably connected to the door and movable between a first state where the door is in the closed position and a second state where the door is in the open position for shifting the door from the closed position to the open position;

forming a blocking member releasable from the carton by creating an aperture in a blocking panel, the blocking member comprising a border portion of the blocking panel adjacent the aperture and releasable from the blocking panel when the depending gripping tab is moved from the first state to the second state; and positioning the blocking member over the depending gripping tab for substantially preventing movement of the depending gripping tab from the first state to the second state prior to releasing the blocking member to substantially prevent shifting of the door from the closed position to the open position.

* * * * *

UNITED STATES PATENT AND TRADEMARK OFFICE

CERTIFICATE OF CORRECTION

PATENT NO. : 7,097,093 B2
APPLICATION NO. : 10/303684
DATED : August 29, 2006
INVENTOR(S) : Darin et al.

It is certified that error appears in the above-identified patent and that said Letters Patent is hereby corrected as shown below:

-In col. 11, line 63, claim 8, delete “carton” and insert -- carton, the opening --.

-In col. 12, line 63, claim 16, after “of the” delete “of the”.

-In col. 13, line 12, claim 18, delete “dosed” and insert -- closed --.

-In col. 13, line 28, claim 19, delete “panels” and insert -- panels, --.

-In col. 13, line 30, claim 19, delete “tap” and insert -- top --.

Signed and Sealed this

Twelfth Day of December, 2006

JON W. DUDAS
*Director of the United States Patent and Trademark Office*